United States Patent [19]

Lopata et al.

[11] Patent Number: 4,465,883

[45] Date of Patent: Aug. 14, 1984

[54] BULLET LUBRICANT AND METHOD OF COATING BULLETS WITH SAID LUBRICANT TO REDUCE THE LEADING EFFECT THEREOF ON THE BORES OF FIREARMS

[75] Inventors: Frances G. Lopata, Clayton, Mo.; Venkataramaraj S. Urs, Godfrey, Ill.

[73] Assignee: Olin Corporation, Stamford, Conn.

[21] Appl. No.: 407,392

[22] Filed: Aug. 12, 1982

[51] Int. Cl.[3] ..... C10L 1/16

[52] U.S. Cl. ..... 585/9; 29/1.22; 86/19; 102/511; 252/11; 252/56 R; 585/3

[58] Field of Search ..... 585/3, 9; 252/56 R, 252/11; 86/19; 102/511; 29/1.22

[56] References Cited

U.S. PATENT DOCUMENTS

| | | | |
|---|---|---|---|
| 1,678,162 | 7/1928 | Pedersen | 585/9 X |
| 1,780,566 | 11/1930 | Pedersen | 86/19 X |
| 2,244,705 | 6/1941 | Hutchinson et al. | 252/56 R X |
| 2,298,844 | 10/1942 | Schilling et al. | 252/56 R |
| 2,346,124 | 4/1944 | Dew | 102/511 X |
| 3,012,981 | 12/1961 | Podlipnik | 252/56 R X |
| 3,267,035 | 8/1966 | Tillman | 252/50 R X |
| 3,942,408 | 3/1976 | Bernath | 86/19 |

FOREIGN PATENT DOCUMENTS

| | | | |
|---|---|---|---|
| 304948 | 1/1929 | United Kingdom | 86/19 |

*Primary Examiner*—Andrew Metz
*Attorney, Agent, or Firm*—Bruce F. Burdick

[57] ABSTRACT

A bullet lubricant is disclosed which includes a miscible amount of low molecular weight polyethylene polymer or ethylene-vinyl acetate copolymers in a wax base. The lubricant has a melting point in excess of 180° F. The lubricant is applied by first heating a bullet and the mix to a pre-determined temperature then coating the bullet and cooling the bullet to allow the lubricant to solidify.

9 Claims, No Drawings

BULLET LUBRICANT AND METHOD OF COATING BULLETS WITH SAID LUBRICANT TO REDUCE THE LEADING EFFECT THEREOF ON THE BORES OF FIREARMS

BACKGROUND AND SUMMARY OF THE INVENTION

The present invention relates to lubricants and, more particularly, to lubricating compositions especially adapted for use in conjunction with projectiles and firearms and methods of applying such lubricants.

This invention is also directed to a method of coating bullets to reduce the "leading effect" thereof on bores of firearms through which the bullet is projected and to preventing fouling of automated equipment used for loading bullets into shell casings therefor.

One of the more important problems with unjacketed bullets is known as "leading," which is the phenomenon of lead from the bullet being deposited, by melting or otherwise, on the interior surfaces of the gun barrel. When this occurs, it is difficult to fire the bullets accurately and consistently even with exactly matched loads in a firearm even from a fixed position. The performance of bullets is of utmost importance to those policemen and soldiers whose very lives depend on their bullets' performance. In an attempt to overcome the detrimental effects of leading, commercial ammunition manufacturers and individual hand loaders have adopted various expedients. One of these consists of jacketing or partially jacketing the lead bullet with gilding metal, a copper base alloy nominally containing 5 percent zinc. Unfortunately, while the jacketed bullet is a significant advance in the art, it too has disadvantages, the more important of which include expensiveness and "copper fouling"; i.e., the transferance of copper from the bullet to the inner surface of the barrel. Recently aluminum jacketed bullets have been introduced for pistol and revolvers to solve the leading problem at reduced cost and yet allow suitable upset upon impact. Yet, this round is not suitable for rifles where bullet velocities are high enough to cause aluminum fouling.

It becomes apparent that the foregoing improvements have not been complete answers to all of the problems besetting the marksman. Indeed, the proposed solutions to many of the problems have not only frequently raised difficult new problems but also have served to emphasize the problems remaining unsolved. For example, friction was once considered to be such a small factor of ballistics that it was often ignored. Now, the opposite is true particularly since it is known that even a relatively low velocity can create sufficient frictional heat to actually melt the surface of a lead bullet and cause leading in the barrel and lead gases to be produced. Furthermore, gun barrel imperfections even though microscopic in size can cause small particles of metal jackets, zinc bases or lead to become embedded in the surface of the barrel. Continued firing only creates additional deposits which can shift positions within the barrels resulting in erratic trajectories.

Efforts to counteract frictional forces with most prior art wax lubricants have not been too successful particularly where the was lubricant selected is a candle wax or one that has been employed to combat frictional effects in a non-ballistics application. A probable reason for the failure of such a wax lubricant may be traceable to the sometimes severe conditions encountered in shooting a firearm where bullet velocities may be as high as 3,000 or 4,000 feet per second and where pressures on the bullet may be as high as 50,000 pounds per square inch. In addition, many of the prior art wax lubricants, including those intended for ballistics applications, are nothing more than greased wax compounds. These lubricants are unstable at the frictional temperatures and pressures encountered by a bullet rapidly traveling through a gun barrel. Furthermore, the prior art greased wax compounds are tacky and thus tend to pick up grit and sand particles which can contribute to, rather than inhibit, barrel wear. Some of the other prior art wax lubricants suffer from the disadvantage of being too costly or too difficult to apply to either the firearm or the ammunition.

The whole broad problem of providing a suitable wax lubricant for ballistics applications is rendered even more difficult by the necessity that the lubricant possess a formidable array of anomalous characteristics. For example, it should be noncorrosive to both surfaces it is to lubricate. It should remain stable over the entire temperature range encountered in ballistic applications. It should be fairly inexpensive. It should have the capacity to tenaciously fill any pores in the barrel and yet provide a fairly smooth surface.

Although many attempts were made to overcome the foregoing difficulties and other disadvantages, none was entirely successful when carried into commercial practice.

In addition to the ballistic considerations above there are production considerations. As noted above, it is a common practice in loading bullets into shell cases to coat each bullet, prior to loading, with a lubricant to reduce the "leading effect" of the bullet on the bore of the firearm through which the bullet is projected. The most commonly used lubricant is beeswax which presents a problem in that a residue of the beeswax slowly builds up on the loading mechanism of automatic equipment used to load the bullets into the shell cases. This residue eventually clogs the mechanism to the point that it requires curtailment of production for the purpose of disassembling the loading equipment for cleaning. It has remained a problem to find suitable compositions for coating bullets without at the same time creating problems in use of automated loading equipment.

In addition to the above concerns there is the more recent recognition that improperly ventilated indoor ranges can develop sufficient levels of lead gases under intensive shooting conditions to be a possible health hazard unless the bullets are coated or jacketed.

Yet, those precise ranges have a maximum need for inexpensive target ammunition so any such coating or jacket should be cheap to make so that ranges can shoot a maximum number of rounds within a given ammunition budget without health hazards.

One proposed solution, as per U.S. Pat. No. 4,196,670 issued Apr. 8, 1980 to M. K. Vartsvog, was a method for coating bullets with a non-wax composition which, it was claimed, reduces the "leading effect" of the bullet on the bore of a gun without, at the same time, fouling the mechanism of automated equipment used for loading bullets into shell casings therefor. The Vartsvog composition contained molybdenum disulfide dispersed in a suitable carrier therefor such as a synthetic resin which is dissolved in a volatile hydrocarbon solvent. The coating was allowed to dry on the bullets by evaporation of the volatile solvent before loading the coated bullets into shell cases. However, this second method has the obvious drawback of requiring hazardous volatile solvents to be used with the resultant added costs of extra safety equipment.

A similar approach which substituted the well-known lubricant coating Nylon 11 or other conventional lubricant coating such as polyethylene, together with the conventional additive molybdenum disulfide in powder form onto a pre-heated bullet, is taught by Oberg, et al. U.S. Pat. No. 4,328,750 issued May 11, 1982. However, this latter method has the drawback that $MoS_2$ tends to separate out of the mix, thus requiring continual agitation. Also, high bullet heats are required since the bullet heat is used to melt the coating powder. Also the powder is applied by fluidized bed reactors which require high volume air supplies, are expensive and require maintenance.

A previous attempted solution to the problems, also utilizing $MoS_2$ grease as an additive to paraffin wax was that of U.S. Pat. No. 3,356,029 issued Dec. 5, 1967 to J. V. Seidel wherein the lubricating compositions contain, on a weight basis, paraffin wax and wheel-bearing grease (e.g. a lime soap thickened lubricant) in a ratio of between 0.8:1 and 1.2:1 with the balance essential discrete particles of molybdenum disulfide ($MoS_2$) in amounts of at least 2 percent but not more than 20 percent, e.g., 5 percent to 20 percent, the lubricating composition is a substantially homogenous mixture of wax and grease with the $MoS_2$ substantially uniformly dispersed there through, and the ratio of paraffin to grease is advantageously 1:1. However, the production problems noted above are not addressed by the composition of the Seidel patent, and a messy $MoS_2$ grease must be introduced to the process with resultant extra cleanup effort being required.

From the above, it becomes apparent that the existing lubricants still have many drawbacks and a better lubricant is needed.

Applicants have unexpectedly been able to provide a non-migratory, flexible, high melting point, high vapor pressure, strongly adhesive, modified wax lubricant without even requiring molybdenum disulfide additions, although $MoS_2$ could be added if desired. Specifically applicant provides a bullet lubricant which comprises from about 3 percent to about 10 percent by weight of low molecular weight polyethylene in a wax base.

In another aspect, the invention provides a method of lubricating a bullet, which method comprises the steps of:

(a) heating the bullet to a temperature within the range of from about 180° F. to about 330° F.;
(b) heating a lubricant mix comprising at least 3% by weight low molecular weight polyethylene polymers in a wax base to a temperature within the range of from about 250° F. to about 300° F.;
(c) coating said heated bullet with said heated lubricant mix;
(d) removing excess lubricant from said bullet; and
(e) cooling said coated bullet to a temperature below the melting point of the wax base to solidify said coating.

The advantages of the invention will be better understood upon reference to the following detailed description.

DETAILED DESCRIPTION OF THE PREFERRED EMBODIMENTS

A wax is modified according to the invention by addition of from about 3 percent to about 15 percent low molecular weight polyethylene or in a suitable wax base and the resulting modified wax is applied to a bullet by a hot melt procedure, described in detail below, such as dipping in a molten bath of the modified wax and then removing the excess wax by a centrifuge or other means and then allowing the bullet to cool and the wax to solidify. "Polyethylene" is used below in its ordinary sense to mean a straight or branched chain paraffin hydrocarbon polymer. "Wax" is used in its ordinary sense to mean a substance having the following five properties:

(a) crystalline to microcrystalline structure;
(b) capacity to acquire gloss when rubbed (distinction from greases);
(c) capacity to produce pastes or gels with suitable solvents or when mixed together with other waxes;
(d) low viscosity at just above the melting point (distinction from resins and plastics);
(e) low solubility in solvents for fats at room temperature.

A low molecular weight polyethylene is used as an additive to the wax of the present invention in order to reduce brittleness of the wax, increase flexibility and minimize tackiness of surface.

"Low molecular weight polyethylene" as used herein means a polyethylene polymer with an average molecular weight within the range of from about 1500 to about 5000.

One suitable low molecular weight polyethylene ("LMWPE") is AC #392 made by Allied Corporation (formerly Allied Chemical Corporation) of Morristown, New Jersey. AC No. 392 is an oxidized polyethylene which has a softening point of about 280° F., a hardness of below 0.5, a density of 0.99 g/cc, a viscosity of 9000 cps at 284° F. Another suitable LMWPE is Bareco polywax No. 2000 produced by Bareco Division of Petrolite Corporation of Tulsa, Oklahoma, which has a melting point of 257° F. A suitable wax base is Ceresin SP 624 made by Strahl & Pitsch of West Babylon, New York, which has a melting point of 200° F. and another suitable wax base is Be Square 185 made by Bareco Division of Petrolite Co. of Tulsa, Oklahoma.

"Microcystalline" (or "amorphous") wax as used herein means a wax having an average molecular weight within the range of from about 460 to about 800 with an average of about 35–60 carbon atoms in the basic carbon chain. This is distinguished from "paraffin" waxes which have average molecular weights of about 350–450 and about 25–34 carbons in the basic carbon chain. Microcrystalline waxes are generally tougher, more flexible, and have higher melting points than paraffin waxes.

The "hot melt" method as used herein means a method in which the wax base and the additive are mixed and then heated or heated and then mixed until a uniform mix is achieved and a desired temperature of, for example, 280° F. is obtained. Although the preferred LMWPE has a softening point of about 280° F., it dissolves in the hot melt bath at a lower temperature. The bullets are then immersed in the hot melt solution either by dipping the bullets into the solution or by pouring the solution over the bullets. Preferably, the bullets are heated to somewhere near 280° F. before being immersed in the hot melt solution in order that the bullet will not make control of the hot melt temperature difficult by acting as a heat sink and unduly cooling the hot melt bath, although the bullet could be preheated to lower temperatures if desired. Once immersed, the bullets are preferably held in an immersed condition for some predetermined time on the order from about three to twenty seconds and then the excess hot melt solution ("lubricant") is removed from the bullet by a suitable procedure such as centrifuging the coated bullet while it cools or (in laboratory quantities) simply rolling the bullets down an inclined supported paper towel. Once the excess lubricant is removed, the bullet is stood on end to cool, thereby allowing the lubricant to solidify and harden. The range of the LMWPE additive modifier concentration in the modified wax lubricant is preferably between 3 and 10 percent by weight. Tests with less than 3 percent (namely 2 percent) have indicated that concentrations under 3 percent provided inadequate coverage of the bullet and do not alter the wax base sufficiently to achieve the desired results. On the other hand, concentration of modifier greater than a miscible amount in the wax base cloud the wax and fail to dissolve and gave too little flexibility to the resultant lubrication and caused the bullet coating to crack or pop loose during cooling or subsequent firing in a firearm.

The lubricant coating should be non-migratory, non-tacky, non-leading, slippery, waterproof, flexible, adhesive to lead and relatively hard. It has been found that a hot melt bath having a temperature in excess of about 330° F. degrades the wax base so fast than an unsatisfactory lubricant can result. It is thus preferred to keep the molten lubricant below 330° F. during the hot melt procedure and preferably below 290° F. if possible. In order to understand what is meant by the terms "non-tacky" and "slippery" additional definition of the test procedures by which such quantities are measured for purposes of comparison will be given. Tackiness is an undesirable attribute and is measured by rolling the dried (i.e., cooled) coated bullet in talc and determining the number of grams of talc which the bullet picks up. This can then be compared with talc pickup for other lubricants. The number of grams of talc picked up is determined by weighing the bullet before and after it is rolled in the talc and determining the difference in weight. If the lubricant picks up a significant amount (0.03 gm or more) of talc, it can be reasonably expected that the lubricant will similarly pick up metal particles and debris which might damage a gun barrel. "Slipperyness" means minimal coefficient of sliding friction and is a desirable attribute. Maximum slipperyness is desirable in order to minimize the friction between the bullet and barrel when a bullet is fired from a firearm. A slippery bullet should go faster and hence travel farther than a non-slippery bullet when fired from the same gun. It is desirable that the coated bullet be more slippery than the uncoated bullet.

The test used herein to measure flexibility is to deform a lubricated bullet by loading it into a cartridge case and knife crimping the neck of the case against the bullet and determine whether or not the lubricant deforms similarly to the bullet or separately deforms. This is done by checking whether or not a waterproof seal between the bullet and case is maintained or instead the lubricant cracks and allows the powder in the loaded case to get wet during prolonged water immersion tests. A flexible coating is also more likely to withstand the impacts and deformations that would be expected to occur during shipping and also during passage of a bullet through a barrel when fired. Adhesiveness is a desirable attribute of a bullet lubricant indicating how strong the lubricant sticks to a lead bullet. If the lubricant does not stick firmly to the bullet, the lubricant may never make it down the barrel, but may be lost instead in shipping, in the magazine, during chambering or immediately upon firing. The adhesiveness can also be determined by deforming a bullet and noting whether or not the coating still adheres to the deformed bullet. Cohesiveness is also a desirable attribute meaning the lubricant stays together. That is, the lubricant sticks to itself. A conventional test to determine cohesiveness is to scratch the bullet with a fingernail or knife and see if the lubricant is scraped loose from itself or not and if scraped loose, to what extent. Another desirable attribute of a bullet lubricant is that it be non-migratory meaning that the lubricant should not move, flow, or "migrate" from its intended location on the bullet and get into the propellant powder which propells the bullet since the powder's performance may be affected by its being contaminated with lubricant resulting in poor powder performance. Also the lubricant should not smear onto an otherwise good looking cartridge case. The lubricant should also be aesthetically pleasing and should not discolor the bullet or case or otherwise make the loaded round ugly. Non-leading has been discussed above and is a desirable attribute. The lubricated lead bullet should not leave a trail of lead in the gun barrel. Not only does it foul up the gun, it can throw the bullet off course by deforming the bullet in an irregular and unpredictable manner as it travels down the gun barrel.

In order to determine the extent to which the lubricant of the invention possesses desirable attributes, a number of examples are given below in order to more fully explain the details of the invention:

EXAMPLE 1

A modified wax having the composition:

| AMOUNT | INGREDIENT | PERCENT BY WEIGHT |
|---|---|---|
| 13.20 grams | Strahl & Pitsch Wax #624 | 93% |
| .99 grams | AC #392 LMWPE | 7% |

is mixed in a heated vessel and heated until a uniform mixture is present at 280° F. 158 grain, 0.357 semi-wad cutter magnum bullets are coated by the following "hot melt" method:

(1) heat the lubricant mixture while stirring until uniform to 280° F.;
(2) heat the bullet to be coated to 275° F.;
(3) dip the heated bullet in the heated lubricant mixture and hold immersed for five seconds;
(4) remove coated bullet from the lubricant mixture and roll down an incline slope over paper towels to remove the excess lubricant coating from the bullet;
(5) stand the rolled, coated bullet upright (nose up) and allow to drain and cool to room temperature.

The bullet is weighed before and after the hot melt procedure and the weight of the coating is determined as the difference between those weights. One hundred ten bullets are coated with the modified wax according to the above procedure and ten are tested for tackiness. Tackiness is found to be less than 0.0003 grams of talc.

Water immersion testing of ten bullets shows good flexibility. The coating appears uniform, adhesive, non-migratory and aesthetically pleasing. Leading tests are run on fifty bullets and no leading is observed. (The leading is determined by scraping off the lead deposit from the barrel with a brush after the fifty bullets are fired through the barrel, and weighing the collected lead.) For purposes of comparison, the above procedure is repeated using fifty more bullets of identical nature only substituting for the above modified wax a modified wax having the following composition:

| AMOUNT | INGREDIENT | PERCENT BY WEIGHT |
|---|---|---|
| 14.92 grams | Strahl & Pitsch wax #624 | 95% |
| 1.75 grams | AC 392 LMWPE | 5% |

Tackiness is again found to be less than 0.0003 grams of talc. A slight, but unobjectionable crumbling of lubricant occurs in the knurls. The coating appears smooth and uniform and slipperyness is good and similar to that of the preceding test. The coating is again flexible, adhesive, non-migratory and aesthetically pleasing. Since this 5 percent additive was enough, to further determine the minimum amount of additive needed another identical ten bullets are run through an identical "hot melt" procedure except the modified wax has the following composition:

| AMOUNT | INGREDIENT | PERCENT BY WEIGHT |
|---|---|---|
| 14.91 grams | Strahl & Pitsch wax #624 | 98% |
| 0.30 grams | AC #392 LMWPE | 2% |

This coating appears blotchy and is not uniform indicating insufficient amount of additive in the composition.

EXAMPLE 2

For purposes of comparison the following test is run with and without additive using the hot melt procedure described above but substituting the following modified waxes:

A. Strahl & Pitsch wax #624

B. Strahl & Pitsch wax #624+5% (by weight) AC #392 LMWPE

Upon testing the following results were achieved for tackiness, slipperyness, residue in a Colt 0.357 revolver and in a Smith & Wesson 0.357 revolver and the indicated coating weights were achieved.

| A | B | ATTRIBUTE |
|---|---|---|
| .0002 gm. talc | .0003 gm. talc | Tackiness |
| 22° | 14° | Slip |
| .556 gm. | .254 gm. | Residue in Colt |
| .244 gm. | .026 gm. | Residue in S & W |
| .029 gm. | .048 gm. | Coat Wt. |

What is claimed is:

1. A bullet lubricant which comprises from about 3 to about 15 percent by weight of low molecular weight polyethylene in a wax base, said lubricant having a melting point in excess of 180° F.

2. The lubricant of claim 1 which comprises from about 3 percent to about 10 percent by weight low molecular weight polyethylene in a wax base.

3. The lubricant of claim 2 which comprises from about 4 percent to about 6 percent by weight low molecular weight polyethylene in a wax base.

4. A method of lubricating a bullet, which method comprises the steps of:

(a) heating the bullet to a temperature within the range of from about 180° F. to about 330° F.;

(b) heating a lubricant mix comprising from about 3 to about 15 percent weight of of low molecular weight polyethylene in a wax base to a temperature within the range of from about 250° F. to about 300° F.;

(c) coating said heated bullet with said heated lubricant mix;

(d) removing excess lubricant from said bullet; and (e) cooling said coated bullet to a temperature below the melting point of the wax base to solidify said coating.

5. The method of claim 4 wherein said bullet and lubricant mix are heated to within 10 degrees of each other before said bullet is coated with said mix.

6. The method of claim 4 wherein said coating step includes immersing said bullet in said heated lubricant mix.

7. The method of claim 4 wherein said step of removing excess lubricant further comprises the steps of placing said coated bullets in a centrifuge and rotating said centrifuge to spin off the excess lubricant from said bullet.

8. The method of claim 4 wherein said lubricant mix is heated to a temperature within the range of from about 260° F. to about 300° F.

9. The method of claim 8 wherein said lubricant is heated to a temperature of within a range of about 270° F. to about 290° F.

* * * * *